United States Patent [19]

Löfberg

[11] 4,222,422

[45] Sep. 16, 1980

[54] PLIANT MATERIAL CONTAINER

[75] Inventor: Gustaf G. Löfberg, Landskrona, Sweden

[73] Assignee: Supra Aktiebolag, Landskrona, Sweden

[21] Appl. No.: 45,696

[22] Filed: Jun. 5, 1979

[30] Foreign Application Priority Data

Jul. 11, 1978 [SE] Sweden ..... 7807730

[51] Int. Cl.[3] ..... B65D 33/14

[52] U.S. Cl. ..... 150/1

[58] Field of Search ..... 150/0.5, 1, 3, 8, 11, 150/12

[56] References Cited

U.S. PATENT DOCUMENTS

| | | | |
|---|---|---|---|
| 3,028,897 | 4/1962 | Gooding | 150/1 |
| 4,069,852 | 1/1978 | Löfberg | 150/1 |

FOREIGN PATENT DOCUMENTS 384811 12/1932 United Kingdom .

*Primary Examiner*—Donald F. Norton
*Attorney, Agent, or Firm*—Fleit & Jacobson

[57] ABSTRACT

A container comprises an inner casing and an outer casing and an elongate member extends through a container space formed by the interior of the inner casing. The elongate member is secured to an upper and lower portion of the container, and of the casings, at least the inner casing comprises a pliant or flexible material. For the purpose of relieving the inner casing of stresses and strains, the elongate member is anchored to the upper portion of the container solely at the outer casing, while the upper portion of the inner casing is displaceable along the elongate member. In such a container only the outer casing is subjected to wear, and to the stresses and strains occurring when a full container is lifted. Filling of the container is facilitated by the displaceability of the upper portion of the inner casing along the elongate member.

10 Claims, 7 Drawing Figures

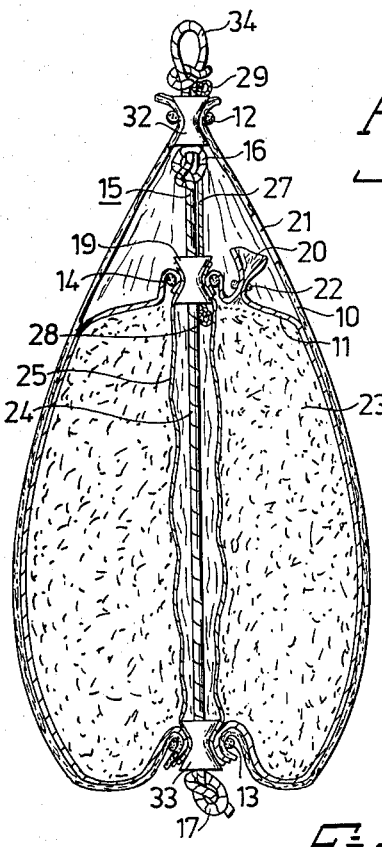
Fig. 3
Fig. 4
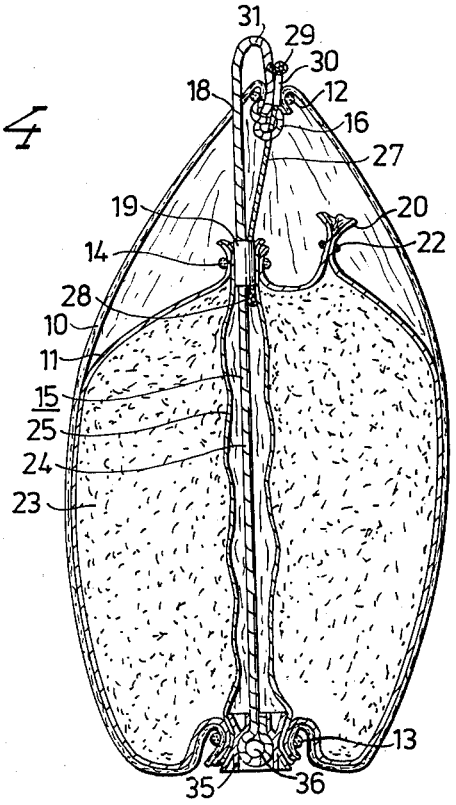

PLIANT MATERIAL CONTAINER

The present invention relates to a container of the type including an elongate member which extends through the container space and which is anchored to an upper portion and a bottom portion of the container.

Containers of this type are known from, for example, United Kingdom Pat. No. 384,811 accepted Dec. 15, 1932, and U.S. Pat. No. 3,028,897. When the dimensions of the container casing of such a container are correctly adjusted, e.g. such dimensions as the distance between locations at which the casing is anchored to the elongate member, to the amount of material contained by the container, the load to which the casing is subjected when the container is lifted will be distributed to some extent between the upper portion and the bottom of the container casing through the elongate member extending through the container space. Many different requirements are placed on the casing of a container of the aforementioned type. Thus, the container casing shall support the weight of the material contained therein and protect it against, for example, the effects of light, moisture, air etc. The container casing must also be capable of withstanding rough-handling and should not be susceptible to wear. Further it must withstand the stresses and strains to which it is subjected when the container is lifted. These different requirements placed on the casing can be difficult to fulfil when the casing is comprised of one single type of material.

An object of the invention is thus to provide a novel and useful container construction in which the aforementioned problems are at least substantially eliminated.

Accordingly this invention consists in a container of the kind comprising an inner casing, an outer casing which encloses said inner casing, and an elongate member which extends through the container space and which is secured to an upper portion and a lower portion of the container, of which casings at least the inner casing comprises a pliant material, and in which container the elongate member at said upper portion is secured solely to the outer casing, and the upper portion of the inner casing is displaceable along the elongate member. As a result of this arrangement, only the outer casing will be subjected to wear and to the stresses and strains occurring when the container is lifted, while the material from which the inner casing is made can be selected solely with the view of protecting the goods held by the container against moisture, light, air etc. Since the upper portion of the inner casing is displaceable relative to the elongate member, when the container is filled and lifted said inner portion will automatically adopt a position in which the inner casing is substantially relieved of load and in which substantially no airfilled spaces will be present in the inner casing of the container, therefor obviating, among other things, the risk of the inner casing rupturing when containers are stacked one on top of the other. Further, the aforementioned ability of the upper portion of the inner casing to move relative to the elongate member permits the upper portion of the inner casing, prior to filling the container, to be held in an upper position adjacent the anchoring location of the upper portion of the outer casing to the elongate member, thereby facilitating filling the container.

In order to prevent the inner casing from sliding too far down the elongate member, or from collapsing in a manner such as to cover the emptying opening in the casing, which opening may be placed in the bottom portion of the container, for example by slitting said bottom portion with a knife, there may be provided in accordance with an advantageous embodiment of the invention a means for limiting the extent to which the upper portion of the inner casing can move relative to the elongate member. Said limiting means may comprise in accordance with a simple embodiment of the invention a connection between the inner and outer casing created by means of e.g. an adhesive. This connection can be placed at a distance from the upper portion of the inner and the outer casing such as not to prevent said automatic releaving of the load on the inner casing by sliding of its upper portion relative to the elongate member.

For the purpose of facilitating the filling of the container, for example whilst it is suspended from its upper end, there can be provided a device which is actuable from outside the container in a manner such as to releasably secure the upper portion of the inner casing in the neighbourhood of the location at which the elongate member is anchored to the upper portion of the container. This securing or holding device is released at the final stage of a filling operation, or subsequent to said filling operation, in a manner such that the inner casing is automatically relieved by sliding of the upper portion of said inner casing relative to the elongate member.

In accordance with a particularly preferred embodiment, the device actuable from outside the container comprises a further elongate member which is connected to the upper portion of the inner casing and extends therefrom longitudinally displaceably through the upper portion of the outer casing to a location externally thereof, and which further elongate member is releasably fixable in a position in which the upper portion of the inner casing is located adjacent to or in the neighbourhood of the upper portion of the outer casing. In this way, prior to filling the container, the upper portion of the inner casing can readily be brought to a position suitable for filling the container.

For the purpose of making emptying of the container relatively easy, the further elongate member may also be fixable in a second position in which displacement of the upper portion of the inner casing is limited.

Although it is possible within the scope of the invention to use a rigid outer casing, the casings of the container according to the invention preferably have the form of open-ended, pliant hose-like elements which are gathered at their respective ends around the elongate member extending through the container space, optionally via intermediate members. Conveniently, for the purpose of preventing wear of the pliant inner casing, the upper portion of said inner casing is gathered around an intermediate member displaceably mounted on the elongate member extending through the container space.

For the purpose of protecting the material contained in the container in a simple and effective manner against any moisture and water which might migrate along said elongate member, that part of the elongate member located within the container space may be enclosed in a tube of soft and pliant material, said tube extending between the upper portion of the inner casing and the location at which the elongate member is anchored to the bottom portion of the container, said tube being operative to shield said elongate member from the container space in a liquid-tight fashion.

Further, for the purpose of automatically distributing the loads to which the outer casing of the container is subjected when the container is lifted, the elongate member extending through the container space may extend displaceably through an opening at the upper portion of the outer casing in a manner such as to form between said opening and said anchoring location at said upper portion of said casing an open loop to receive a lifting device for lifting said container.

To enable the invention to be more readily understood and further features thereof made apparent, a number of embodiments of the invention will now be described with reference to the accompanying drawings, in which FIGS. 1 and 2 are axial sectional views of a first embodiment of a container according to the invention, with the container empty and filled respectively.

FIGS. 3 and 4 illustrate respectively in axial sectional view a second and a third embodiment of a container according to the invention.

Corresponding elements of the various embodiments have been referenced by the same numerals in the different Figures of the drawings.

Figure 1:
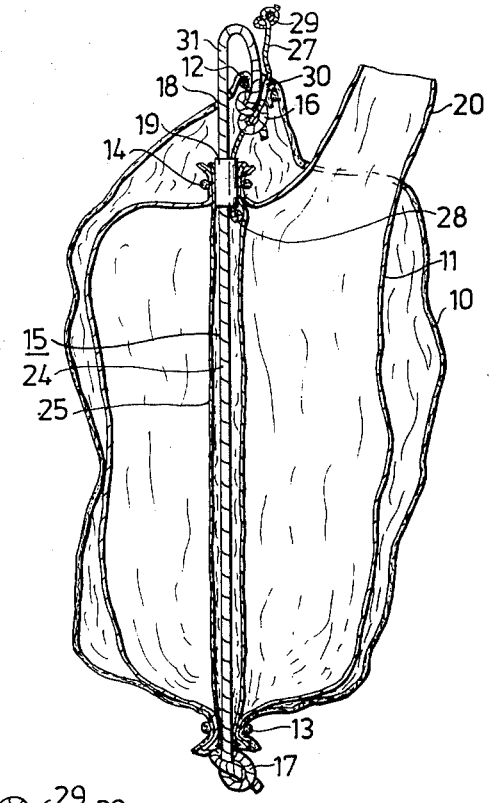
Figure 2:
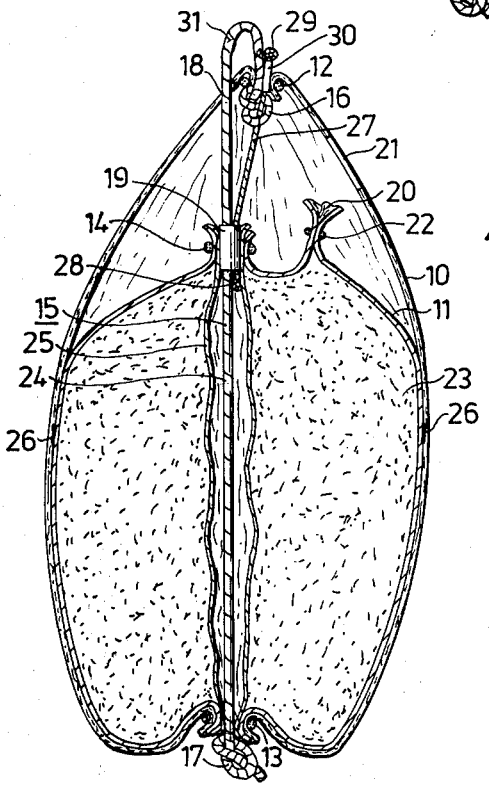

The sack-like container illustrated in FIGS. 1 and 2 comprises an outer casing 10 and an inner casing 11, both of which have the form of hoses made from a pliant material and are gathered around an elongate member 15 at their respective ends by means of securing devices 12, 13, 14, which may have the form of ropes or clamps. As illustrated, the elongate member 15 may comprise a rope or any other suitable elongate member such as a chain etc. The hose forming the casing 11 conveniently has a diameter which is slightly greater than the diameter of the hose forming the casing 10.

The elongate member 15 has at each end thereof a knot 16 and 17 each forming a thickened portion which together with the securing members 12, 13 causes the lower end of the member 15 to be anchored to the bottom portions or respective casings 10, 11 and the upper end of the member 15 to be anchored to the upper portion of the casing 10. In this respect, the upper end of the casing 10 is folded out-and-in in a manner such that the thickened portion 16 is placed within the casing 10, the elongate member 15 extending out through the portion of the casing 10 gathered by the member 12 and thereafter, at 18, through a hole formed in the upper portion of the casing 10, back into said casing 10. The member 15 extends downwardly through the interior of the casings 10, 11, said member 15 passing through the gathered upper end of the casing 11 held by the securing member 14, and the lower ends of the casings 10, 11 held by the member 13. Although each end of the member 15 is locked or secured against axial movement in only one direction by the thickened portions 16, 17 and the members 12, 13, further thickened portions or knots may be arranged on the member 15 on the sides of the members 12 and 13 opposite to the thickened portions 16 and 17, in order to secure or lock each end of the member 15 against axial movement in the other axial direction, although this is not normally necessary, since the member 15 does not tend to move relative to the members 12, 13 in said other direction, i.e. in a direction downwardly in FIGS. 1 and 2, when the container is handled in a normal manner.

The upper end of the inner casing 11 is gathered around the member 15 at a sleeve 19 which loosely surrounds the member 15 and sleeve which can be provided with an internal, for example peripherally extending, stiffening element or bead opposite the securing means 14 but which in other respects shall be relatively soft in order to prevent damage to the member 15 or to other parts of the container. The member 15 is thus displaceable at 18 relative to the casing 10 and at 19 relative to the casing 11.

The casing 11 is provided with a so-called filling valve 20 which can be pulled through a slot shown at 21 (FIG. 2), to facilitate filling of the container and which can be closed-off from outside the container and then inserted into the outer casing 10 to protect said valve, as illustrated in FIG. 2, in which a means for closing-off the valve 20 is shown at 22. In order to protect the material 23 contained by the container against any moisture and water which may migrate along the elongate member 15, that portion 24 of said member 15 which extends through the container space, i.e. the interior of the casing 11, is enclosed in a tube or hose 25 of soft, pliant and water-tight material. The two ends of the hose 25 are secured by the securing members 13 and 14 together with the lower ends of the casings 10, 11 and the upper end of the casing 11.

In order to limit the extent to which the upper portion of the inner casing 11 can move relative to the elongate member 15, there may be provided, as indicated at 26 in FIG. 2, a connection, which may have the form of an adhesive connection, between the casings 10, 11. Alternatively, an elongate member 27 may be provided which has one end connected to the sleeve 19 whilst its other end extends displaceably out through the outer container casing. By means of the elongate member 27, the sleeve 19 can be drawn from outside the container to a position adjacent the thickened portion 16, whereupon filling of the container is facilitated by the fact that the inner casing 11 cannot collapse in a manner such as to block the flow of material from the valve 20 to the interior of the casing 11. In the illustrated embodiment the member 27 extends displaceably through the sleeve 19 and is provided at its bottom end with a thickened portion 28 in the form of a knot which is unable to pass through the space between the sleeve 19 and the elongate member 15. Thus, when that part of the member 27 located outside the container is pulled, the sleeve 19 is moved along the member 15 towards the knot 16. In order to prevent the whole of the member 27 from passing into the outer casing 10, said member is also provided with a thickened portion 29, for example in the form of a knot, at its upper end. In the illustrated embodiment, the member 27 extends through the upper end of the casing 10 which is gathered by the securing device 12, whereupon the member 27 in the neighbourhood of the member 12 is able to move through a sleeve, as shown at 30, which permits axial movement of the part of the member 27 located between the thickened portions 28, 29 without any appreciable friction, but whose diameter is smaller than the diameter of the thickened portion 29. The sleeve 19 can be held in a desired position relative to the thickened portion 16 by tying a readily releasable knot (not shown) on the part of the member 27 located outside the container immediately adjacent the upper end of the sleeve 30. This last mentioned knot is released or untied subsequent to, or during the final stage of a container-filling operation, whereby the upper portion of the casing 11 automatically moves downwardly along the member 15 to a position in which it will be subjected to a minimum of stresses and strain. The casing 11 can therefore be manufactured of a material of relatively low mechanical strength. Alternatively, the sleeve 19 can be held in an upper position by means of a member which shall later form the closure means 22 for the valve 20, thereby ensuring that the measures required for relieving the load on the casing 11 are not forgotten. The upper thickened portion 29 limits movement of the upper portion of the casing 11 downwardly along the member 15 and thereby prevents the inner casing from falling excessively downwardly or collapsing when emptying the container through an opening formed in the bottom portion of the container, for example an opening in the form of a circular slot extending around the lower anchoring location and located in said bottom portion.

That part 31 of the elongate member 15 located between the upper anchoring location of said member 15 and the opening 18 forms an open or inverse U-shaped eye or loop in which a lifting hook or the like (not shown) can be inserted for lifting the container, said hook preferably permitting sliding of the member 15. In this way, when the container together with its contents is lifted, the stresses and strains acting in the elongate member 15 will be substantially uniformly distributed between the two parts of the U-shaped eye, to be distributed in this way to the anchoring location of the member 15 at the upper and lower portions of the container. Thus, the elongate member 15 extending through the container space forms a load-distributing device which automatically transfers part of the total load acting on the member 15, when the container and its contents are lifted, to the bottom portion of the container, where said load is substantially taken up by the outer casing 10 while the inner casing 11 is supported effectively by the casing 10 and automatically takes a position in which the load thereon is minimum.

In the embodiment illustrated in FIG. 3, the sleeve 19 has an hour-glass configuration, i.e. is waisted or has a circumferential extending groove, thereby ensuring a more positive connection between the sleeve 19 and the upper portion of the casing 11. Further, the upper portion of the casing 11 is folded in-and-out and the bottom portion and the upper portion of the container are also connected to the elongate member 15 via intermediate members 32 and 33 of hour-glass configuration. The intermediate member 33, and optionally also the intermediate member 32, is suitably formed in the same manner as the sleeve 19, thereby enabling moisture or water entering through the sleeve 19 to depart from the hose 25 through the sleeve 33. The elongate member 15 extends through the sleeve 32 and is formed externally of the container into a closed loop 34, thereby preventing any appreciable distribution of the load to the casing 10 when lifting the container by the eye or loop 34. The inner casing 11 is, however, relieved of stresses and strains in the manner described with reference to FIGS. 1 and 2.

The embodiment illustrated in FIG. 4 is substantially the same as the embodiments shown in FIGS. 1 and 2. In the FIG. 4 embodiment, however, the casings 10, 11 are gathered at the bottom portion of the container around the elongate member via an intermediate member 35, said member having a substantially hour-glass-configuration, i.e. is waisted or provided with a circumferential extending groove. For the purpose of saving material, the member 35 may be provideed with recesses or like cavities, as illustrated in the Figure, and said member 35 is through-passed axially by a hole which together with a wedge-shaped or round insert 36 forms a wedge-locking device for releasably fixing the lower end portion of the elongate member 15. In the illustrated embodiment, the hole passing through the intermediate member 35 has an upper part whose cross-sectional area and shape are such as to correspond substantially to the cross-sectional area and shape of two mutually adjacent parts of the elongate member 15, a lower part whose cross-sectional area and shape are such as to substantially correspond to the largest cross-section of the insert 36 and two parts of the element 15 located on a respective side of the insert, and an intermediate upwardly tapering portion. The end portions of the member 15 are fixed in the intermediate member 35 by laying said member 15 around the insert 36 and then inserting it into the hole in the manner shown in FIG. 3. It will be seen that the wedging effect obtained between on one hand the tapering part of the hole and on the other the insert 36 and the parts of the member 15 surrounding said insert increases when a tension force is placed on the part of the member 15 designated 24. The intermediate member 35 may comprise a suitable plastics material and for the purpose of increasing the load-absorbing ability of the intermediate member 35, the hole passing through said member can, to advantage, be provided with a reinforcing lining in at least the said intermediate, upwardly tapering portion.

Figure 5:
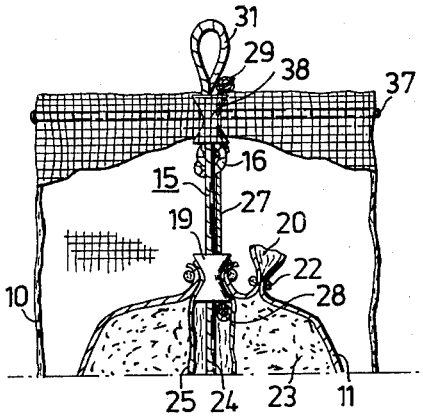
FIGS. 5 and 6 illustrate partially in axial sectional view and partially in side view the upper portion of a fourth embodiment of a container according to the invention before and during closing of the outer casing of said container.
Figure 6:
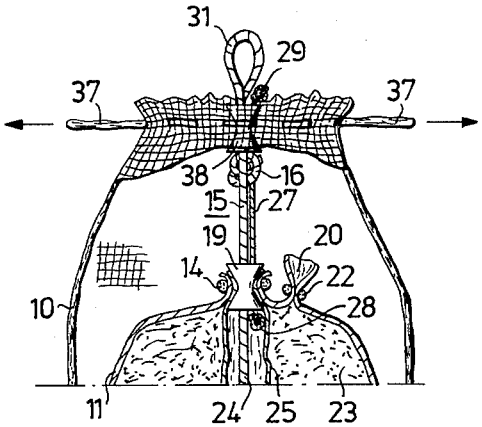
Figure 7:
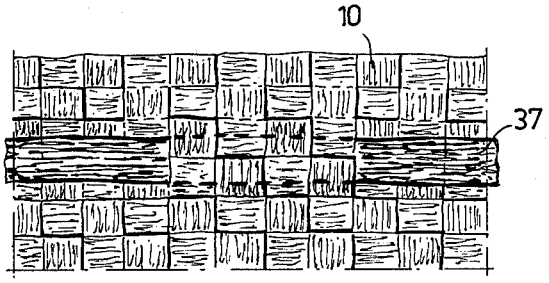
FIG. 7 illustrates a part of the upper portion of the outer container casing according to FIGS. 5 and 6.

In the embodiment of the container shown in FIGS. 5–7, the outer casing 10 comprises a woven fabric in which separate bands 37 can be woven, as will best be seen from FIG. 7. The upper and optionally also the lower end of the casing 10 is gathered around the elongate member 15 by means of said bands and by means of similar bands at the opposite end of the casing 10, optionally via an intermediate member 38 of hour-glass configuration, as indicated by arrows in FIG. 6. The band can then be used to tie the casing 10 to the waisted centre of the intermediate member 38. In the embodiment of the intermediate member shown in FIGS. 5 and 6, said member is provided with three axially extending holes (not shown), the member 27 extending displaceably through one hole, while the member 15, as seen from the thickened portion 16, extends up through the other hole and down through the third hole to form an open or U-shaped loop or eye which, in the manner aforedescribed, causes distribution of the stresses and strains between the upper portion and the bottom portion of the container when lifting said container by means of a lifting hook inserted in said eye or loop.

The invention is not limited to the aforementioned and illustrated embodiments, but can be modified within the scope of the following claims. For example, the rope 27 may comprise an end portion of a rope which forms the securing member 12, that part of said rope-end portion located between said securing member 12 and the sleeve 19 can be releasably connected to the elongate member 15, for example by means of the member which is later to form the valve-closing member 22, at a location such that the sleeve 19 is automatically moved to a desired upper position when hanging the container on a hook or the like passing through the eye or loop 31. It also lies within the scope of the invention to lock the rope 27 to the sleeve 19 by friction, by clamping the rope 27 firmly between the outside of the sleeve 19 and the casing 11 or the hose 25 by means of the member 14.

The embodiments of the invention in which an exclusive property of privilege is claimed are defined as follows:

1. A container, comprising an inner casing and an outer casing which encloses said inner casing, wherein an elongate member extends through a container space formed by the interior of said inner casing and is secured to an upper portion and a lower portion of the container, of which casings at least the inner casing comprises a pliant material, and wherein the elongate member at said upper portion is secured solely to the outer casing, and the upper portion of the inner casing is displaceable along the elongate member.

2. A container according to claim 1, characterized by means for limiting the extent to which the upper portion of the inner casing can move relative to the elongate member.

3. A container according to claim 2, characterized in that the means for limiting said movement of the upper portion of said inner casing along said elongate member comprises a connection between the inner and the outer casing.

4. A container according to claim 1 or 2, characterized by a device actuatable from outside the container in a manner such as to releasably secure the upper portion of the inner casing in the neighbourhood of the location at which the elongate member is secured to the upper portion of the container.

5. A container according to claim 4, characterized in that the device actuable from outside the container comprises a further elongate member which is connected to the upper portion of the inner casing and extends therefrom longitudinally displaceably through the upper portion of the outer casing to a location externally thereof, and which further elongate member is releasably fixable in a position in which the upper portion of the inner casing is located adjacent the upper portion of the outer casing.

6. A container according to claim 5, characterized in that the further elongate member can be fixed in a second position in which it permits limited displacement of the upper portion of the inner casing.

7. A container according to claim 1, characterized in that the casings have the form of pliant hose-like elements gathered at their open ends around the elongate member extending through the container space.

8. A container according to claim 7, characterized in that the upper portion of the inner casing is gathered around an intermediate member displaceably mounted on the elongate member extending through the container space.

9. A container according to claim 7 or 8, characterized in that the elongate member extending through said container space is enclosed in a tube of soft pliant material, which extends between the upper portion of the inner casing and the location at which the elongate member is secured to the lower portion of the container, and which shields said elongate member from the container space in a liquid-tight fashion.

10. A container according to claim 1, characterized in that the elongate member extending through the container space extends displaceably through an opening at the upper portion of the outer casing and forms between said opening and the location at which the elongate member is secured to the upper portion of the container a loop for receiving a lifting device for lifting said container.

* * * * *